United States Patent [19]

Stiles

[11] 4,148,144

[45] Apr. 10, 1979

[54] OVAL COMPASS

[75] Inventor: Walter E. Stiles, Phoenix, Ariz.

[73] Assignee: Ron L. Norman, Phoenix, Ariz. ; a part interest

[21] Appl. No.: 902,860

[22] Filed: May 4, 1978

[51] Int. Cl.[2] ..... B43L 11/04
[52] U.S. Cl. ..... 33/31
[58] Field of Search ..... 33/31

[56] References Cited

U.S. PATENT DOCUMENTS 717,082 12/1902 Dart ..... 33/31

FOREIGN PATENT DOCUMENTS 466204 10/1928 Fed. Rep. of Germany ..... 33/31

*Primary Examiner*—Harry N. Haroian
*Attorney, Agent, or Firm*—Warren F. B. Lindsley

[57] ABSTRACT

An ellipse drawing instrument employing a drawing arm, and a pair of members adapted to be connected to the drawing arm at two spaced points on the drawing arm, one of the members being constrained to move along a first path and the other of said members being constrained to move along a second path crossing the first path so that in use, as the members reciprocate along their respective paths, a point of the arm describes an elliptical path.

The paths are linear and perpendicular to each other.

1 Claim, 5 Drawing Figures

OVAL COMPASS

BACKGROUND OF THE INVENTION

This invention relates to an instrument for facilitating the drawing of ellipses, ovals and their paths. Technical and geometrical drawings are frequently needed in the manufacture of parts or all of a piece of equipment and are a necessary part of drawings reflecting accurately the size and position of various parts.

There are known drawing procedures for contructing such an elliptical path but they are generally painstaking, time consuming and unless great care is taken, inaccurate.

PRIOR ART

Although a number of patents have been granted relating to devices for drawing elliptical paths they have not disclosed a simple and accurate instrument for accomplishing this function as claimed herein.

U.S. Pat. No. 3,562,915 discloses an ellipse drawing instrument, the parts of which do not control the slidable members for controlling the drawing arm with the degree of accuracy needed by applicant and in a manner necessary to obtain this accuracy.

Although U.S. Pat. Nos. 932,768; 973,047; 2,452,484 and 2,827,702 disclose drafting instruments which may be used for drawing oval and elliptical paths, none of these patents disclose the simple but accurate device, i.e. oval compass disclosed herein which employs a pair of stops in one of the slotted members which cause this slotted member to move relative to the other slotted member to provide its function with a simple but accurate instrument.

SUMMARY OF THE INVENTION

In accordance with the invention claimed, a new and improved oval compass is provided employing a drawing arm and a pair of members adapted to be pivotally connected at two spaced points along the drawing arm. One of the members moves along a given path on a common base and the other of the members moves along a given path on a member slidable on the base.

It is, therefore, one object of this invention to provide a new and improved oval compass.

Another object of this invention is to provide an improved ellipsographic device of simple construction with which elliptical and oval paths may be drawn without employing any supplemental devices.

A further object of this invention is to provide an improved oval compass formed of simple elements readily manufactured to produce an efficient construction of moderate cost.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing in which.

DESCRIPTION OF THE PREFERRED EMNBODIMENT

Figure 1:
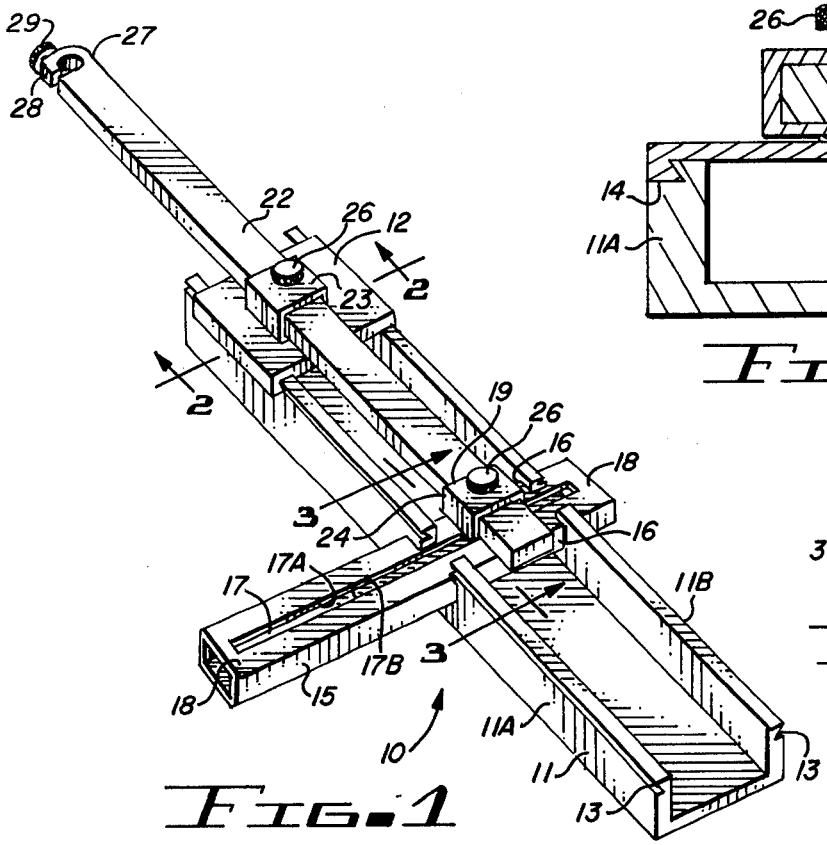
FIG. 1 is a perspective view of an oval compass embodying the invention.
Figure 2:
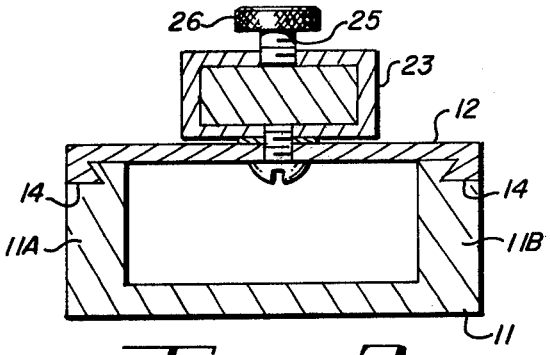
FIG. 2 is a cross-sectional view of FIG. 1 taken along the line 2—2.
Figure 5:
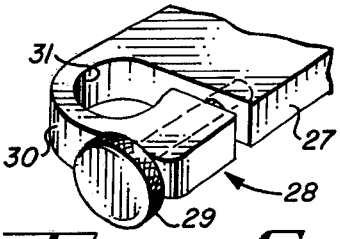
FIG. 5 is an enlarged perspective view of the pencil, pen or scriber holding means.

Referring more particularly to the drawing by characters of reference, FIG. 1 discloses an ellipse drawing instrument or oval compass 10 comprising a base 11 on which is movable longitudinally thereof a sliding member 12. Base 11 comprises an elongated U-shaped channel member the configuration of which defines a path for movement of member 12 therealong. As shown in FIG. 1, the legs 11A and 11B of the U-shaped configuration of base 11 are each provided with a V-shaped groove 13 which cooperates with tongues or protrusions 14 along the sides of the sliding member 12, as shown more clearly in FIG. 2, to form an interlocking sliding fit for guiding member 12 along base 11.

Although member 12 is shown as being guided along base 11 by the interlocking and sliding cooperation of grooves 13 and protrusions 14, it should be recognized that member 12 may be formed to move along base 11 within or between its legs 11A and 11B and still remain within the scope of this invention.

Extending laterally of base 11 is a slotted guiding member 15 which is arranged to move in an axial direction through and along a slotted configuration 16 in base 11. This slotted configuration is such that guiding member 15 when moving laterally of base 11 causes a slot 17 extending longitudinally of it to cross the path in base 11 along which sliding member 12 moves at a 90 degree angle.

Figure 4:
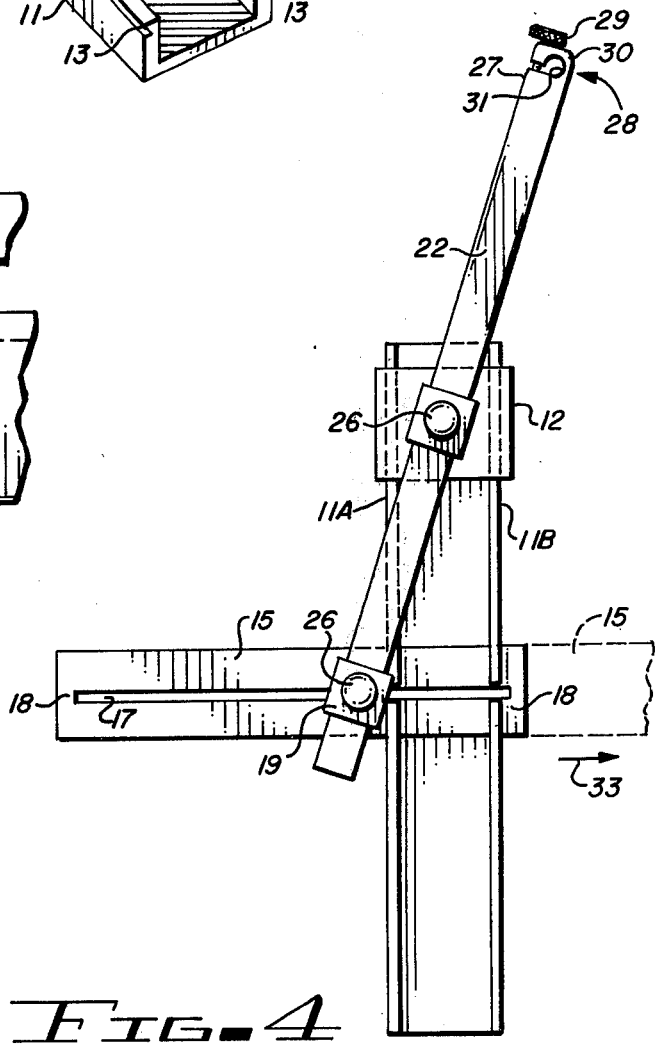
FIG. 4 is a top view of FIG. 1 showing the drawing arm in a different position.

As noted from FIGS. 1 and 4, slot 17 in the hollow tubular guiding member 15 is a closed ended slot, the slot ends 18 of which form stops for a second sliding member 19.

Figure 3:
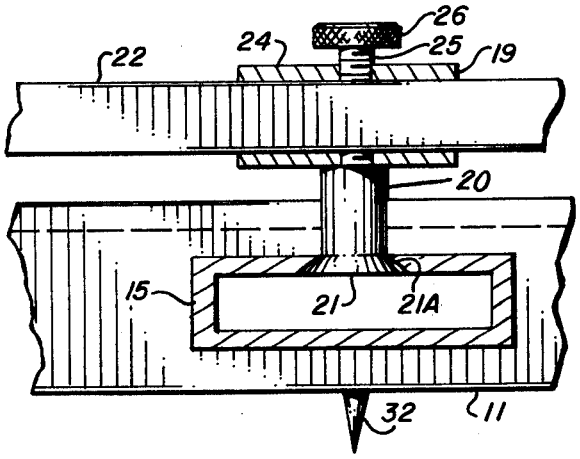
FIG. 3 is a cross-sectional view of FIG. 1 taken along the line 3—3.

FIG. 3 illustrates that sliding member 19 also comprises a hollow tubular member which is provided with a lug 20, the head 21 of which is locked in slot 17 of slotted guiding member for sliding movement therealong. As shown in FIG. 3, the edges of slot 17 taper or flare outwardly of top edges 17A of slot 17 so as to engage with the tapered or flared edge 21A of head 21 of lug 20 so as to not only provide a snug fit between the head and slot peripheries but increases the accuracy of the disclosed oval compass.

FIG. 1 illustrates a drawing arm 22 formed in an elongated configuration which is adjustably positioned to extend between sliding members 12 and 19 at any one of a number of positions. As shown, the sliding members comprise open ended channel members 23 and 24 through which drawing arm 22 extends. Each channel member is provided with a fastening bolt 25 threadedly attached to its respective sliding member and having a knurled head 26 which is used to securably hold drawing arm 22 in a given extended or retracted position relative to the guiding members 12 and 19, in a well known manner.

At end 27 of drawing arm 22 is formed a suitable clamp 28 which is formed to fit around and clampingly engage a pencil, pen or scriber (not shown) for using in marking an oval or elliptical path traversed by this end of drawing arm 22 as guided member 12 is moved along the length of base 11 and guiding member 19 is moved along the length of guiding member 15.

Clamp 28 comprises a bolt 29 threadedly engaged in an opening of a wrap around extention 30 at the end 27 of arm 22 so that as the end of extension 30 is drawn closer to end 27 of arm 22 and a scriber placed longitudinally through opening 31 formed by the wrap around configuration of extension 30 will be tightly gripped.

To hold the oval compass to a given spot on the surface to be worked on the bottom of base 11 may be provided with a position point 32 formed of suitable material for holding the compass in a chosen position.

It should be noted that the adjustability of drawing arm 22 determines the length of the ovals or ellipses and the length of the slot 17 in guiding member 15 determines its width. As drawing arm 22 is moved in a clockwise direction as shown in FIG. 4, slide member 12 moves downwardly along base 11 with slide member 19 moving right to left in slot 17.

At the time drawing arm 22 is moved through the first quarter of a circle it is axially aligned with guiding member 15. At this time the movement of slide member 19 is stopped by the end 18 at the left end of guiding member 15.

As drawing arm 22 continues through the next quarter of a circle sliding member 12 moves from its position at the center of the length of base 11 to the lower end thereof with slide member 19 moving from the stop 18 at the left end of guiding member to the stop 18 at the right end of slide member 15.

During the drawing or scribing of the first half of the oval or elliptical configuration just described, slide member 15 remains in the position shown. When moving sliding member 12 from the lower position of it on base 11 back up to its center position shown in FIG. 4, slide member 19 must move to the right of base 11. To do this slide member 19 must push against stop 18 causing guiding member 15 to move in a perpendicular manner across base 11 in the direction shown by arrow 33 and illustrated by the dash line configuration of guiding member 15.

When the end of drawing arm 22 is again longitudinally of guiding member 15 with the end 27 of drawing arm 22 extending to the left of slide member 15, sliding member 15 has been moved laterally to its extreme right most position.

The next quarter of the oval or elliptical configuration is caused by the movement of sliding member 12 to the top of base 11 as shown in FIG. 4 and slide member 19 moves to the center of base 11.

The novelty of the claimed structure resides in the simple form of the two channels formed by base 11 and guiding member 15 with guiding member 15 moving laterally on and across base 11 in close cooperation between the sliding members 12 and 19 and with a minimum of slack or lost motion between the sliding parts. These sliding members although freely movable along given tracks are so correlated one with the other to cause the scriber fastened to the end of drawings arm 22 to describe perfect ovals or ellipse patterns.

The claimed instrument is simple in construction since guiding member 15 is one half the normal length of similar structures in the prior art and since it is slidably movable relative to base 11 it serves a dual function on each side of base 11 heretofore performed by a guiding member almost twice that length.

Although but one embodiment of the present invention has been illustrated and described, it will be apparent to those skilled in the art that various changes and modifications may be made therein without departing from the spirit of the invention or from the scope of the appended claims.

What is claimed is:

1. An oval compass comprising:

a base defining a first linear path extending along its length, said base comprising a U-shaped configuration having a pair of legs, a tubular guiding member defining a groove forming a second linear path of a predetermined length mounted on said base and extending laterally thereof, said groove having stop means at points along each end thereof for preselecting the length of said second path, said guiding member being movable laterally across said base in a controlled manner and said second path being shorter than the length of said first path, said base being provided with a groove in which said guiding member is mounted for movement laterally of said base under predetermined conditions, a drawing arm, a pair of sliding members adapted to be connected to said drawing arm selectively at spaced points along said drawing arm, one of said sliding members being constrained along the legs of said U-shaped configuration for sliding movement therewith and the other of said members being constrained to move along said second path crossing said first path so that in use as said sliding members reciprocate along their respective paths a point of said drawing arm describes an oval path, said guiding member when in one position extending to one side of said base causing said part of said drawing arm to describe one half of an oval and when said other of said sliding members reaches an end of the path in said guiding member it actuates said guiding member to move said guiding member laterally to the other side of said base to provide a linear path on the other side of said base to cause said part of said drawing are to describe the second half of the oval, said legs being grooved along their non-adjacent edges and said one of said sliding members being provided with protrusions for fitting into said grooves of said legs to form a snug sliding arrangement therewith.

* * * * *

UNITED STATES PATENT OFFICE

CERTIFICATE OF CORRECTION

Patent No. 4,148,144 Dated April 10, 1979

Inventor(s) Walter E. Stiles

It is certified that error appears in the above-identified patent and that said Letters Patent are hereby corrected as shown below:

Claim 1, line 39, after "drawing" delete "are" and substitute ---arm---.

Signed and Sealed this

Tenth Day of July 1979

[SEAL]

Attest:

Attesting Officer

LUTRELLE F. PARKER

Acting Commissioner of Patents and Trademarks